US011039693B2

(12) United States Patent
Gullick

(10) Patent No.: US 11,039,693 B2
(45) Date of Patent: Jun. 22, 2021

(54) SAFETY STOOLS

(71) Applicant: Cara Gullick, Timaru (NZ)

(72) Inventor: Cara Gullick, Timaru (NZ)

( * ) Notice: Subject to any disclaimer, the term of this patent is extended or adjusted under 35 U.S.C. 154(b) by 0 days.

(21) Appl. No.: 16/623,776

(22) PCT Filed: Jun. 23, 2018

(86) PCT No.: PCT/NZ2018/050089

§ 371 (c)(1),
(2) Date: Dec. 22, 2019

(87) PCT Pub. No.: WO2019/004843

PCT Pub. Date: Jan. 3, 2019

(65) Prior Publication Data

US 2020/0345154 A1 Nov. 5, 2020

(30) Foreign Application Priority Data

Jun. 26, 2017 (NZ) ..... 733200

(51) Int. Cl.
*A47D 1/00* (2006.01)
*A47D 1/04* (2006.01)

(52) U.S. Cl.
CPC ..... *A47D 1/006* (2013.01); *A47D 1/004* (2013.01); *A47D 1/04* (2013.01)

(58) Field of Classification Search
None
See application file for complete search history.

(56) References Cited

U.S. PATENT DOCUMENTS

| | | | | | |
|---|---|---|---|---|---|
| 2,534,413 | A * | 12/1950 | Cenis | A47C 4/021 | 297/440.13 |
| 3,788,700 | A * | 1/1974 | Wartes | A47B 85/00 | 297/440.13 |
| 5,000,514 | A * | 3/1991 | Hanson | A47C 3/029 | 211/189 |
| 5,803,548 | A * | 9/1998 | Battle | A47C 3/029 | 297/271.6 |
| 6,189,974 | B1 * | 2/2001 | Beck | A47C 4/021 | 297/440.13 |
| 6,955,401 | B1 * | 10/2005 | Shoulberg | A47C 3/029 | 297/440.13 |
| D680,338 | S * | 4/2013 | Strickland | D6/345 | |
| 9,756,963 | B2 * | 9/2017 | Bien-Willner | A47D 9/00 | |
| 9,981,677 | B1 * | 5/2018 | Gross | A47B 31/00 | |
| 10,575,649 | B2 * | 3/2020 | Pelletier | A47C 4/021 | |
| 2006/0061191 | A1 * | 3/2006 | Pelletier | A47C 7/68 | 297/440.12 |

(Continued)

FOREIGN PATENT DOCUMENTS

WO WO-2007055575 A2 * 5/2007 ..... A47C 4/021

*Primary Examiner* — David E Allred

(57) ABSTRACT

A safety stool/learning tower and method of assembling same, the safety stool having a first wall, at least two side walls, a second wall, and a platform, wherein the at least two side walls are configured to locate one on each side of the first wall, and wherein the second wall is configured to engage with the first and second walls, characterised in that, when engaged, the second wall interlocks the first and second walls with the first wall, and wherein the platform is configured to engage with at least two opposing walls of the interlocked first wall, at least two side walls and second wall.

14 Claims, 9 Drawing Sheets

(56) References Cited

U.S. PATENT DOCUMENTS

2010/0038935 A1* 2/2010 Walter ..... A47D 1/04
297/130
2016/0258461 A1* 9/2016 Muller ..... A47B 47/0075

* cited by examiner

SAFETY STOOLS

TECHNICAL FIELD

The present disclosure relates to safety stools, and more particularly to safety stools for children.

BACKGROUND ART

Interacting with children is fundamental to their intellectual and social development. Small children are curious and want to observe and engage in what other people are doing. Typically the activities a child is interested in observing and interacting in are undertaken on a bench or table that is at a height that precludes interaction by the child.

Lifting a child onto a table or bench to observe and interact with some activity creates the dangerous situation where the child can easily fall and become injured. Similarly, standing the child on a chair or traditional stool is unsafe due to the potential for a fall injury. It is also desirable that whilst a child can observe and interact with parents and the activity, the parent is able to maintain control. In particular the child must be limited in their ability to reach items on the bench or table, such as power tools, knives, needles, chemicals, electrical cords, hot items such as drinks, choking hazard items or anything else that could be of danger; the child must be able to observe and interact without risk of falling, and the child must be prevented from being able to walk, or crawl, away whilst the parent is occupied with the activity. The parent must have the discretion to move safe for play items into the child's reach, whilst the child is restrained from reaching unsafe for play items.

Safety stools for children (which are also commonly referred to as a learning tower) have been designed for such child parent interaction. One such example is described in WO2006090170. The stool described in WO2006090170 provides an adjustable height platform that is surrounded by four walls. The platform is slid into pairs of horizontal slots formed in a pair of adjacent walls of the stool. The slots are provided at a number of heights providing adjustability depending on a child's height.

The stool described in WO2006090170 provides a safe secure platform on which a child can be restrained, whilst still being able to engage with a parent and an activity. However, stools of this nature do have a number of disadvantages. In particular, the base portion that provides stability, and structural rigidity, prevents the stool from being positioned with the front wall abutting against a bench. This limitation is due to the base extending past the front wall of the stool. Unless there is a recess at the base of the bench against which the stool is positioned, the base holds the stool away from the bench. In some situations this causes a large gap to be present between the stool and the bench or table. This large gap is where a child will interact with play items, in order to prevent the continuous dropping of items. Such safety stools typically require a tray to be added above the gap to reduce the occurrence of dropped play items. Ideally a small gap will be present between the front of a stool and a bench or table, this protects a child's' fingers or hands from being pinched or crushed between the stool and a bench or table when the safety stool is being positioned.

Such safety stools are also bulky and require considerable storage space when not in use. Dismantling and assembling the stool between uses is impractical as the process requires tools and is slow.

The assembly of safety stools of the type described in WO2006090170 also require a reasonable degree of skill to assemble, requiring tools, care not to damage fasteners and a substantial time commitment. As with all modular furniture care must be taken not to cross thread screws, or otherwise cause damage to the stool during assembly, the fastening systems used are also not typically designed for being constantly dismantled and reassembled.

Also of inconvenience is the need to lift a child over the walls of the stool prior to lowering them onto the platform, this is particularly true as a child grows, becomes heavier, and the platform is lowered deeper and deeper into the stool. This action requires the parent to lift the child high enough to clear the side walls and to then lower them into the stool, risking strain injury.

It is an object of the present invention to address at least one of the foregoing problems, or at least to provide the public with a useful choice.

Further aspects and advantages of the present invention will become apparent from the ensuing description which is given by way of example only.

SUMMARY

According to a first aspect of the present invention there is provided a safety stool including:

an adjustable platform;

a first wall unit, and a second wall unit, wherein the first wall unit includes a plurality of supports configured to receive and support the adjustable platform, and wherein the second wall unit is configured to removably attach to the first wall unit, characterised in that:

a) when the second wall unit is attached to the first wall unit a wall is formed above a surface of the adjustable platform which substantially surrounds the periphery of the platform;

b) when the second wall unit is not attached to the first wall unit at least a portion of the periphery of the platform is not enclosed by a wall, thereby providing access to the surface of the platform.

In preferred embodiments the first wall unit includes a substantially planar first wall, and at least two substantially planar side walls.

In preferred embodiments the at least two substantially planar side walls are configured to locate one on either side of the substantially planar first wall.

In preferred embodiments the second wall unit includes a substantially planar second wall.

In preferred embodiments the adjustable platform is substantially planar.

According to a second aspect of the present invention there is provided a safety stool including:

a first wall;

at least two side walls;

a second wall, and a platform, wherein the at least two side walls are configured to locate one on each side of the first wall, and wherein the second wall is configured to engage with the first and second walls, characterised in that, when engaged, the second wall interlocks the first and second walls with the first wall, and wherein the platform is configured to engage with at least two opposing walls of the interlocked first wall, at least two side walls and second wall.

Preferred embodiments may employ a number of features for locating of the side walls on the first wall, examples of which may include, but should not be limited to, protrusions that engage with corresponding apertures, grooves that receive a corresponding tongue of material, or the like. In such embodiments the side walls are not fixed to the first wall, allowing tool free location, and separation, of the side walls from the first wall.

In preferred embodiments the protrusions, apertures, grooves, tongue of material, or the like are formed in, or from, the first wall and side walls, thereby maintaining the nature of those components.

Preferably each of the first wall include a series of locating protrusions that extend outward from the sides of the first wall.

Preferably the side walls includes a series of locating apertures which, in use, align with and locate onto the series of locating protrusions on the planar first wall.

In some embodiments the locating protrusions and locating apertures may be configured to interlock, or friction fit, together which, in use, lock the side walls to the first wall. In such embodiments the protrusions may be formed as hooks, or the like, configured to hook into a corresponding aperture.

In preferred embodiments the locating protrusions and locating apertures do not interlock, instead they support the walls in alignment, preventing the first wall from falling forward or backward and preventing the side walls from falling inwards.

In some embodiments the side walls may be attached to the first wall by way of hinges, thereby allowing the side walls to be folded either in towards and onto, or outwards and away from, the first wall. In such embodiments the structure folds substantially flat for convenient storage.

In some preferred embodiments the side walls are fixed to the first wall, thereby forming a unified 3 sided structure. Fixing of the side walls to the first wall may be made in a number of ways, examples of which include, but should not be limited to, screws, bolts, clips, or the like.

In preferred embodiments the at least two side walls include a plurality of platform holding apertures therethrough, the platform holding apertures configured to, in use, slidingly receive the platform.

In preferred embodiments each of the platform holding apertures include a platform sliding portion and a platform engaging portion. In use the platform sliding portion allows the platform to be freely slid through the aperture, and the platform engaging portion is configured to engage with and prevent the platform from sliding once engaged.

The platform engaging portion may take a number of forms, such as, but not being limited to, a narrower portion of the platform holding aperture, pins, posts, slots, apertures or the like within or adjacent the platform holding aperture that are configured to mate with corresponding features in, or on, the platform.

In some preferred embodiments the platform holding apertures include a groove, channel, recess or the like around an inner periphery thereof. The groove, channel, recess or the like configured to receive a portion of a plug that has substantially the same shape as the aperture. In use plugs may be fitted to any platform holding apertures that are being used to hold a platform. By plugging the apertures a child who is placed in the safety stool is not able to use the apertures as toe holds for climbing out of the safety stool.

In preferred embodiments the platform is rectangular in shape and has a first end and a second end, wherein the first end and the second end each includes a wall engaging portion configured to engage with the platform engaging portion of a platform holding aperture. In use, when the wall engaging portion and the platform engaging portion are engaged, the platform holds the side walls and the first wall together.

In preferred embodiments the second wall includes a series of hook formations that extend outward from the sides of the second wall.

Preferably the side walls include a series of hook formations which, in use, align and engage with the series of hook formations on a side of the second wall.

Preferably the hook formations on the second wall are downward facing in use, and the hook formations on the side walls are upward facing in use. The directionality of the hook formations are configured to facilitate engagement of the walls by lowering of the hook formations of the second wall onto the hook formations of the second wall. Similarly, release of the walls is performed by lifting the second wall, thus lifting the hook formations of the second wall up and out from the hook formations of the side walls.

In some preferred embodiments the first and second wall include a plurality of locking apertures configured to receive a locking member. In use the locking apertures in the first and second walls align coaxially.

In preferred embodiments a locking member is provided that is configured to insert through the locking apertures first and second walls. In use, the locking member passes through the locking apertures in the first and second walls so as to be positioned below and adjacent to the platform.

Preferably the first wall, at least two side walls, second wall, and platform are each substantially planar. The planar nature of the at least two side walls, second wall, and platform allows the dismantled stool to be conveniently stored as a flat pack, for example under a bed or in a wardrobe.

Preferably the locking member also has a planar form allowing it to be stored as a flat pack.

A method of assembling a flat packable safety stool, the method of assembly including the steps of:

a) positioning a first wall in a vertical orientation;
b) locating a first side wall on a first side of the first wall such that a series of locating protrusions on the first side of the first wall extend through a corresponding series of locating apertures in the first side wall;
c) locating a second side wall on a second side of the first wall such that a series of locating protrusions on the second side of the first wall extend through a corresponding series of locating apertures in the second side wall;
d) sliding a platform horizontally through a first platform holding aperture in the first side wall and through a second platform holding aperture in the second side wall;
e) engaging a platform engaging portion of the first and second platform holding apertures with a first and a second wall engaging portion of the platform, and
f) engaging a second wall with sides of the first and second side walls that are distal to the first wall.

In preferred embodiments the first and second wall include a plurality of locking apertures configured to receive a locking member, in such embodiments an additional step g) of inserting a locking member through locking aperture below and adjacent the platform is included.

Preferably the locking member includes a head portion that is not able to pass through the locking apertures. In use, the locking member passes through locking apertures in the first and second walls so as to be positioned below and adjacent to the platform. Once in position the locking member prevents the second wall from being lifted up and out of engagement with the side walls.

In preferred embodiments step b and c locate the first and second side walls relative to the first wall.

In preferred embodiments step e functions to prevent the platform from sliding within the platform holding apertures as well as locking the first and second side walls and the first wall together.

In preferred embodiments prior to performing step fat least a portion of the periphery of the platform is not enclosed by a wall, thereby providing access to the surface of the platform.

In preferred embodiments performing step f results in formation of a wall above a surface of the adjustable platform which substantially surrounds the periphery of the platform.

Preferred embodiments are modular and provide rapid tool free assembly and disassembly. When disassembled the modular planar components can be conveniently stacked and stored.

BRIEF DESCRIPTION OF DRAWINGS

Further aspects of the present invention will become apparent from the following description which is given by way of example only and with reference to the accompanying drawings in which.

DETAILED DESCRIPTION

Figure 1:
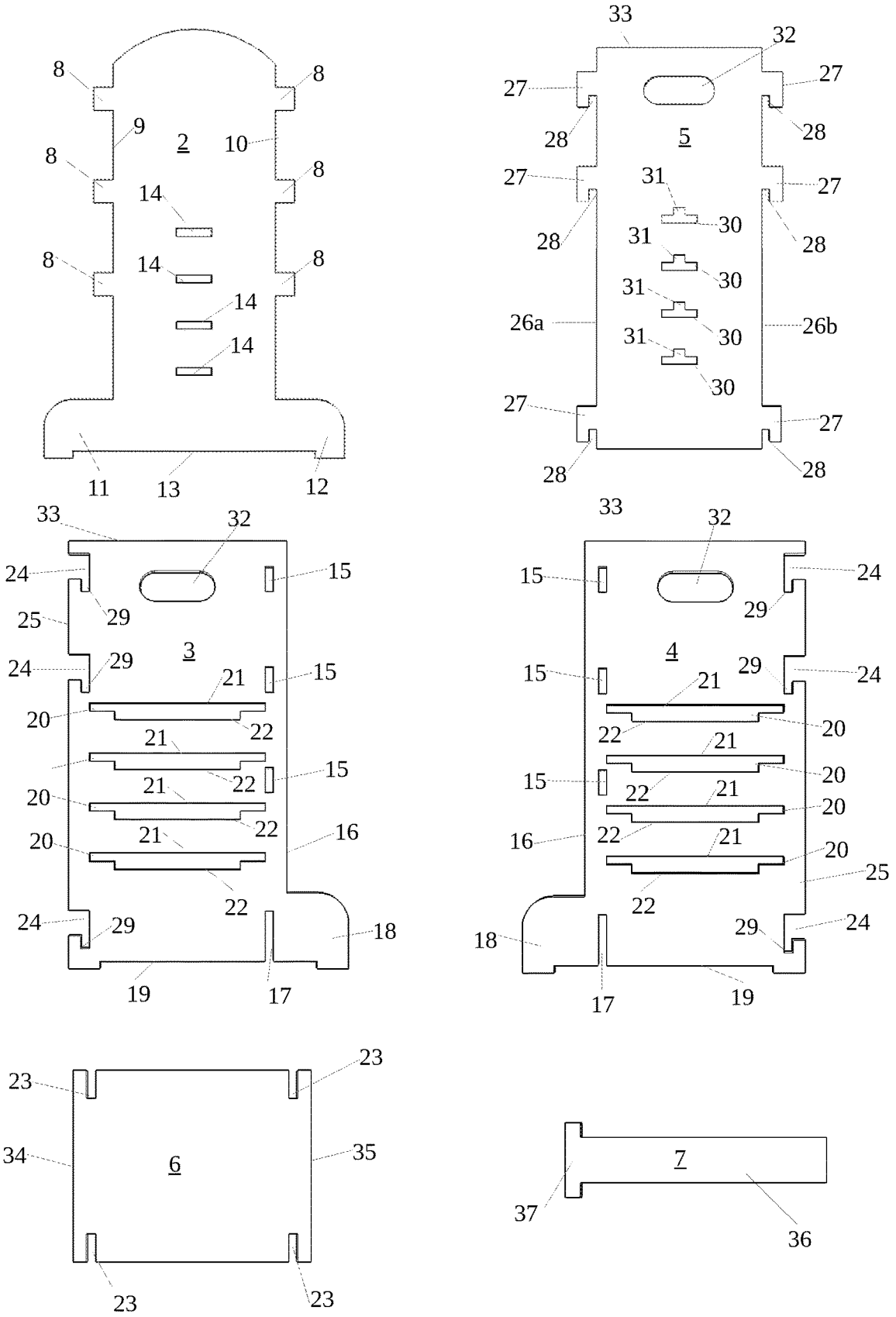
FIG. 1 shows a series of substantially planar components for a safety stool in accordance with the present invention.

Referring to FIG. 1 there is shown an unassembled flat packable safety stool, as generally indicated by designator 1. The flat packable safety stool shown in FIG. 1 includes a substantially planar first wall 2, a first substantially planar side wall 3, a second substantially planar side wall 4, a substantially planar second wall 5, a substantially planar platform 6 and a locking member 7.

The substantially planar first wall 2 includes a series of tab like locating protrusions 8 that extend outward from opposing sides 9, 10. The base 13 of the substantially planar first wall 2 has a pair of side support legs 11, 12 that extend outwards from opposing sides 9, 10. The side support legs 11, 12 are formed as part of the substantially planar first wall 2, the structure thereby remaining substantially planar in form. Also formed along the centre of substantially planar first wall 2 are a plurality of locking apertures 14, configured to receive locking member 7.

First substantially planar side wall 3 and second substantially planar side wall 4 are symmetrical. First and second planar side walls 3, 4 include a series of locating apertures 15 spaced along a first edge 16.

The locating apertures 15 are spaced so as to align with the locating protrusions 8 on the substantially planar first wall 2. First and second planar side walls 3, 4 also include rear support legs 18 that extend from first edge 16. Also included on the base 19 of substantially planar side walls 3, 4 is slot 17, which is configured to locate over one, or other, of side support legs 11, 12 in substantially planar first wall 2. Each of first substantially planar side wall 3 and second substantially planar side wall 4 also includes a plurality of platform holding apertures 20. The platform holding apertures 20 include a platform sliding portion 21 and a platform engaging portion 22. The platform sliding portion 21 is dimensioned so as to allow the substantially planar platform 6 to freely slide therethrough. Platform engaging portion 22 is narrower than platform sliding portion 21 and engages with wall engaging portions 23 of the substantially planar platform 6, thereby preventing sliding of the substantially planar platform 6 once engaged. First substantially planar side wall 3 and second substantially planar side wall 4 also incorporate upward facing hook formations 24 along a second edge 25. These are configured to engage with corresponding downward facing hook formations 27 of substantially planar second wall 5.

Along opposing edges 26*a*, 26*b* of substantially planar second wall 5 are a series of downward facing hook formations 27. The throats 28 of downward facing hook formations 27, in use, align and engage with the throats 29 of the upward facing hook formations 24. The substantially planar second wall 5 also includes locking apertures 30. Locking apertures 30 align with locking apertures 14 in the substantially planar first wall 2 and are also configured to receive locking member 7. Locking apertures 30 include an additional slot 31 which is configured to allow a user to check if the substantially planar platform 6 is present above a particular locking aperture 30.

Each of the substantially planar second wall 5 and substantially planar first and second side walls 3, 4 include handle forming apertures 32 at their respective upper edges 33.

The substantially planar platform 6 is rectangular in shape and has a first end 34 and a second end 35 each of which includes a wall engaging portion 23 that is configured to engage with the platform engaging portion 22 of a platform holding aperture 20. The width of the substantially planar platform 6 is such that it can slide freely through the platform sliding portion 21 of a platform holding aperture 20.

Locking member 7 has a shaft portion 36 and a head portion 37. The shaft portion 36 is configured to slide through locking apertures 30, 14, however the head portion 37 is not able to pass through the locking apertures 30, 14.

In order to aid in the understanding of the components of the present invention, and how they interact, an example will now be given of how one embodiment of a safety stool in accordance with the present invention is assembled and used. It should be understood that the description represents one example of the present invention, only one method of assembly and a single use, as such the example should not be seen as being limiting.

Figure 2:
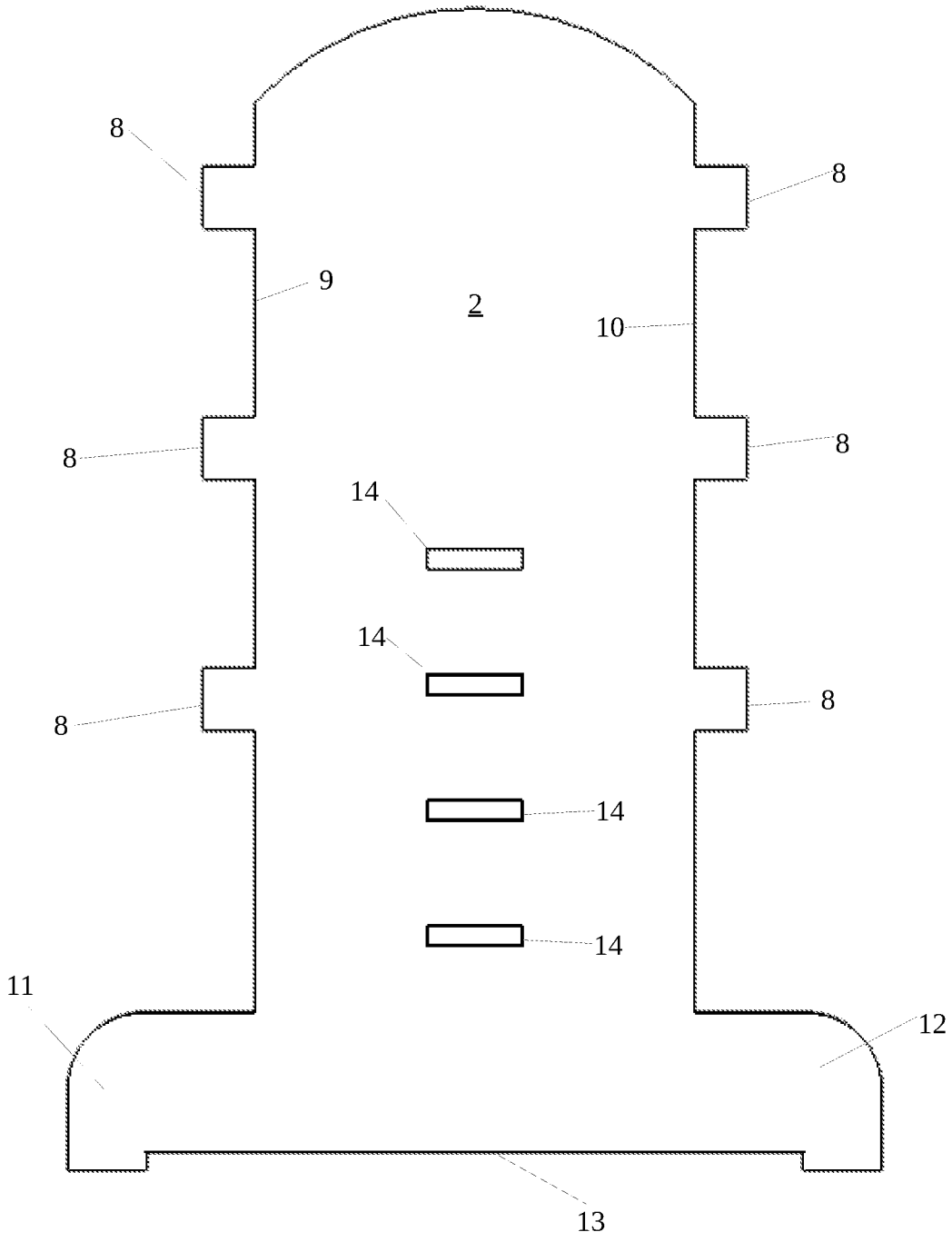
FIG. 2 shows a first stage of assembly of a safety stool in accordance with the present invention.

Referring now to FIG. 2, there is shown a first stage of assembly in which a substantially planar first wall 2 is positioned in a vertical orientation with base 13 positioned on a floor (not shown).

Figure 3:
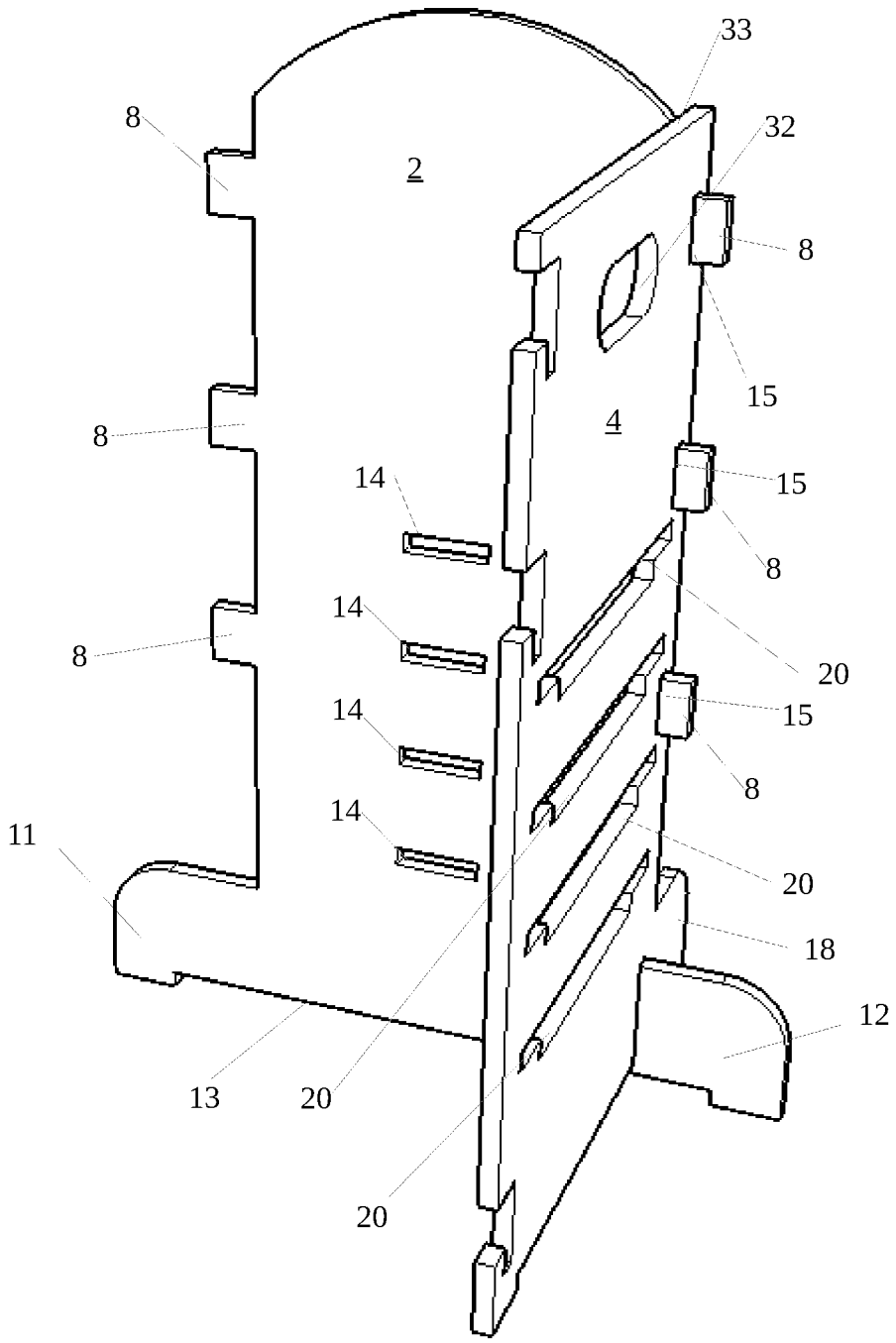
FIG. 3 shows a second stage of assembly of a safety stool in accordance with the present invention.

In FIG. 3 a second step has been completed in which a first substantially planar side wall 4 has been located on a first side 10 of the substantially planar first wall 2. Locating of the first substantially planar side wall 4 involves positioning slot 17 over side support leg 12 and positioning locating protrusions 8 through locating apertures 15.

Figure 4:
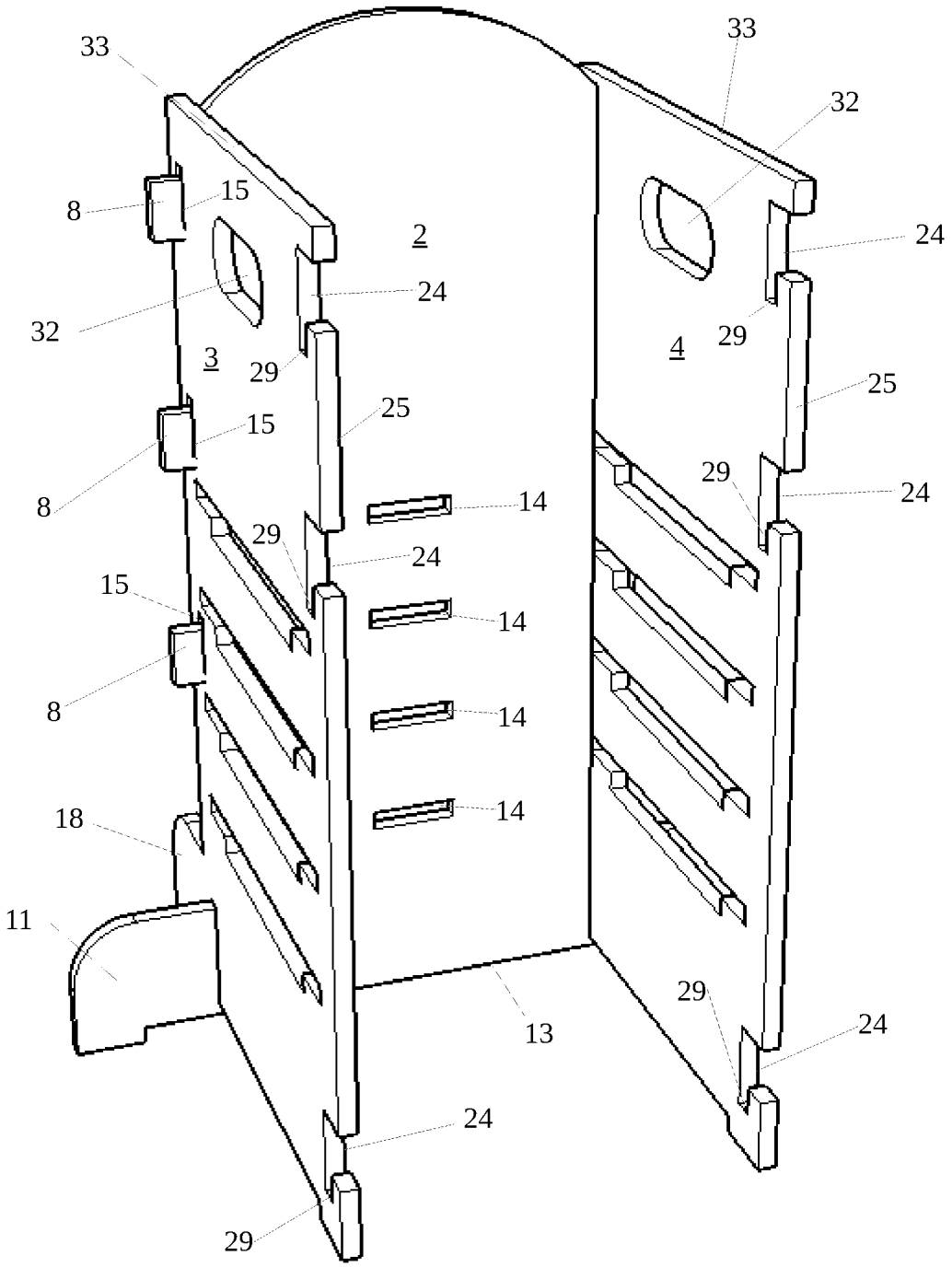
FIG. 4 shows a third stage of assembly of a safety stool in accordance with the present invention.

FIG. 4 shows a third stage of assembly in which a second substantially planar side wall 3 has been located on a second side 9 of the substantially planar first wall 2. The locating process of the substantially planar second side wall 3, 4 is the same as was performed in the second step, with slot 17 being positioned over side support leg 11.

In FIG. 4 the first and second substantially planar side walls 3, 4 are not fixed to, or engaged with, the substantially planar first wall 2. However, the positioning of slots 17 over side support legs 11, 12 and positioning of locating protrusions 8 through locating apertures 15 provides stability to the substantially planar first wall 2, preventing it from falling in any direction. The first and second substantially planar side walls 3, 4 are also prevented from falling toward each other. Friction between the locating protrusions 8 and locating apertures 15 hold the first and second substantially planar side walls 3, 4 from falling outwards away from each other. The structure in FIG. 4 is sufficiently stable to remain upright without additional support, particularly if the first and second substantially planar side walls 3, 4 are canted inwards at their upper edges 33.

Figure 5A:
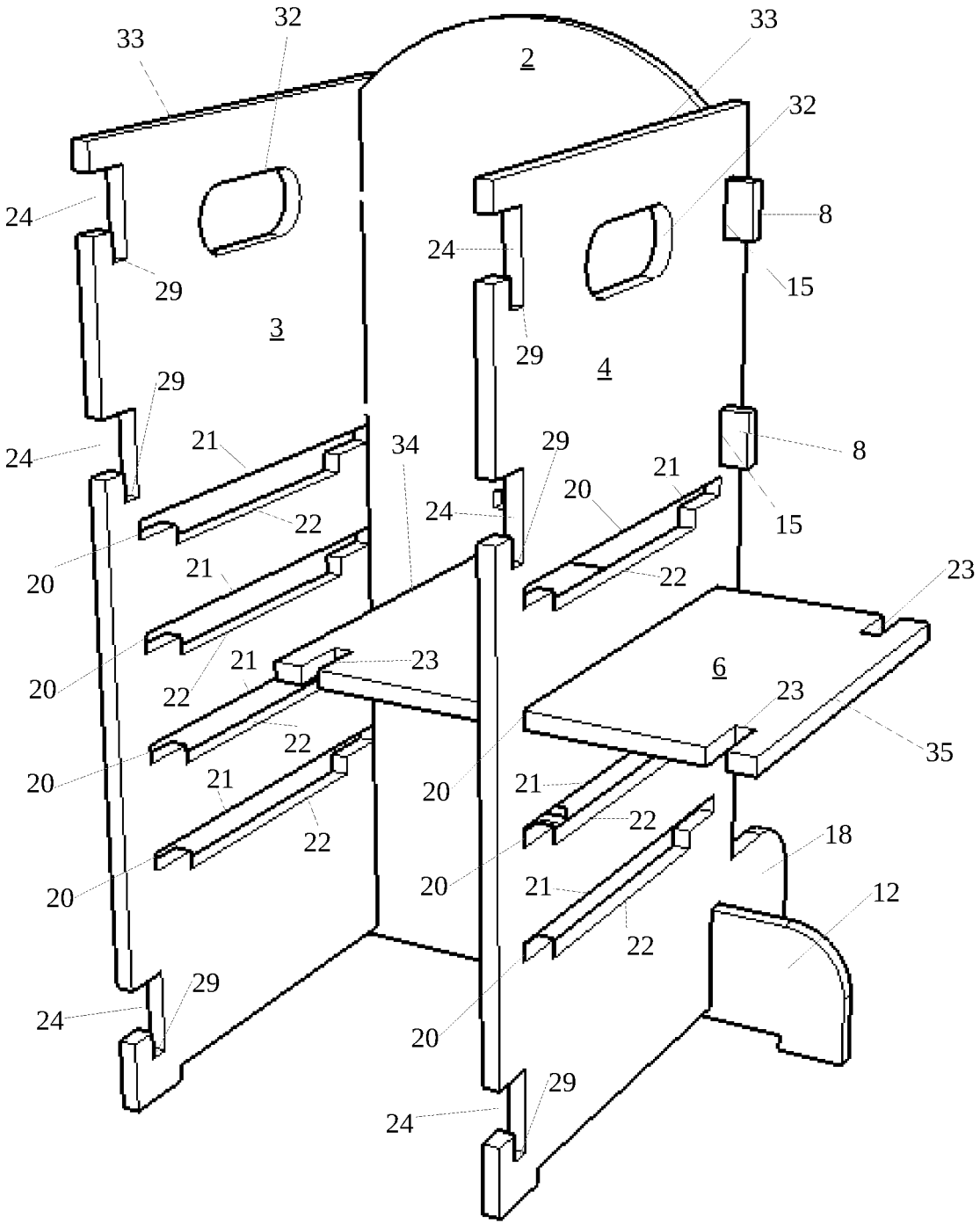
FIG. 5*a* shows a fourth stage of assembly of a safety stool in accordance with the present invention.

In FIG. 5*a* a partially completed fourth stage of assembly is shown, wherein the substantially planar platform 6 is shown positioned through platform sliding portion 21 of a platform holding aperture 20. The greater width and height of the platform sliding portion 21 of the platform holding aperture 20, relative to the substantially planar platform 6, allows the substantially planar platform 6 to slide freely into, and out from, the platform sliding portion 21. The aperture into which the substantially planar platform 6 is slid is chosen based on the height of a child to be restrained, or on the intended use of the stool. For example, if the stool is to form a base for a high chair, the substantially planar platform 6 may be raised to its highest level and a chair placed on it.

Figure 5B:
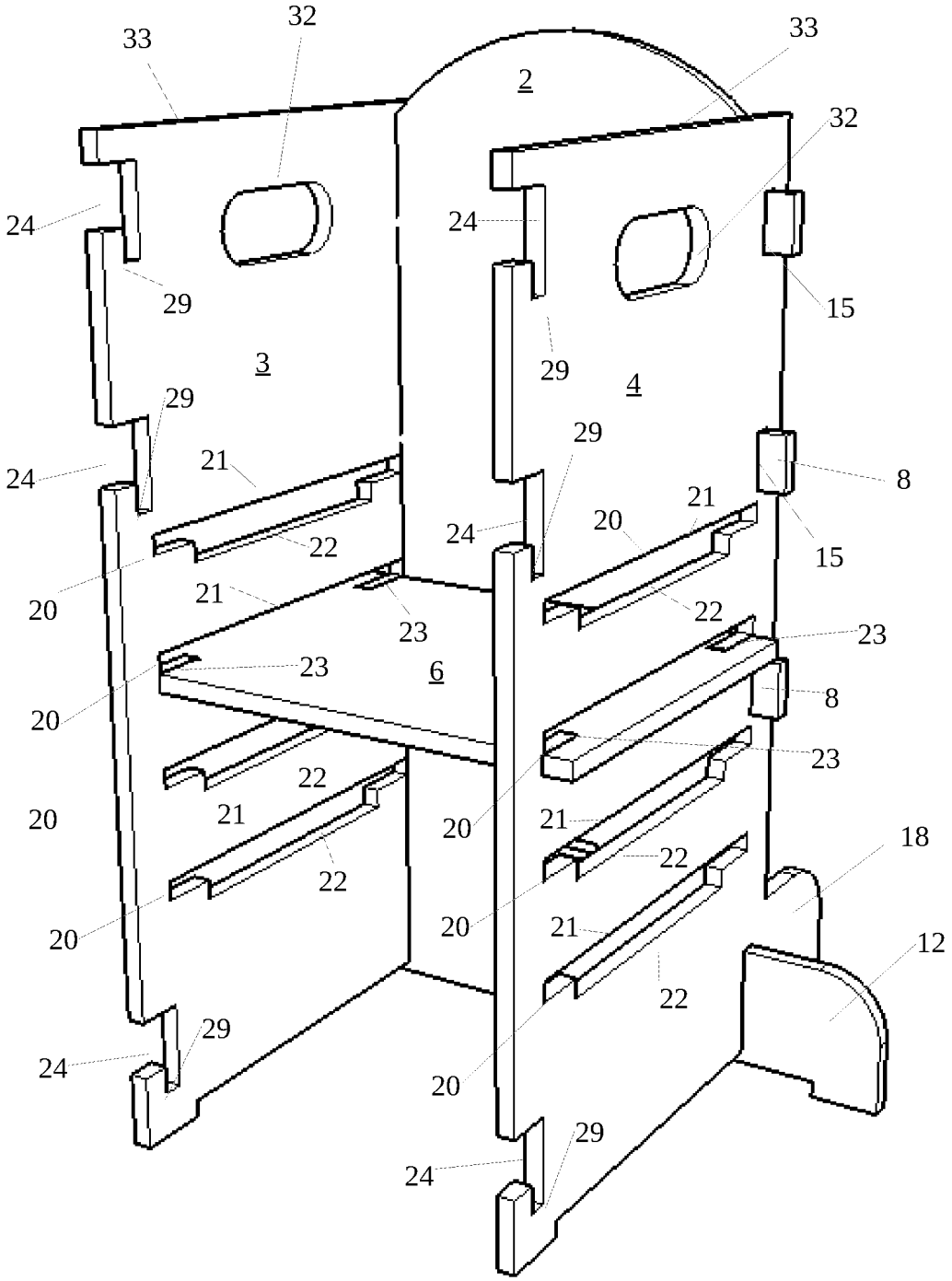
FIG. 5*b* shows a fourth stage of assembly of a safety stool in accordance with the present invention.

FIG. 5*b* shows the completed fourth stage of assembly, in which the substantially planar platform 6 is engaged with platform engaging portions 22. In this position the wall engaging portions 23 of the substantially planar platform 6 slot into the narrower platform engaging portion 22 of first and second substantially planar side walls 3, 4. Engagement of the substantially planar platform 6 with the wall engaging portions 23 of substantially planar side walls 3, 4 holds the substantially planar platform 6 in position, preventing it from sliding, and also holding the first and second substantially planar side walls 3, 4 to the substantially planar first wall 2 by preventing the substantially planar side walls 3, 4 from falling away from the locating protrusions 8.

The safety stool shown in FIG. 5*b* can now be used, either to act as the base for a high chair or the like, or a child can be lifted, or may step, onto the substantially planar platform 6. It will be appreciated that lifting a child onto the substantially planar platform 6 does not require as high of a lift as would be required if the substantially planar platform 6 had walls on all sides.

Figure 6:
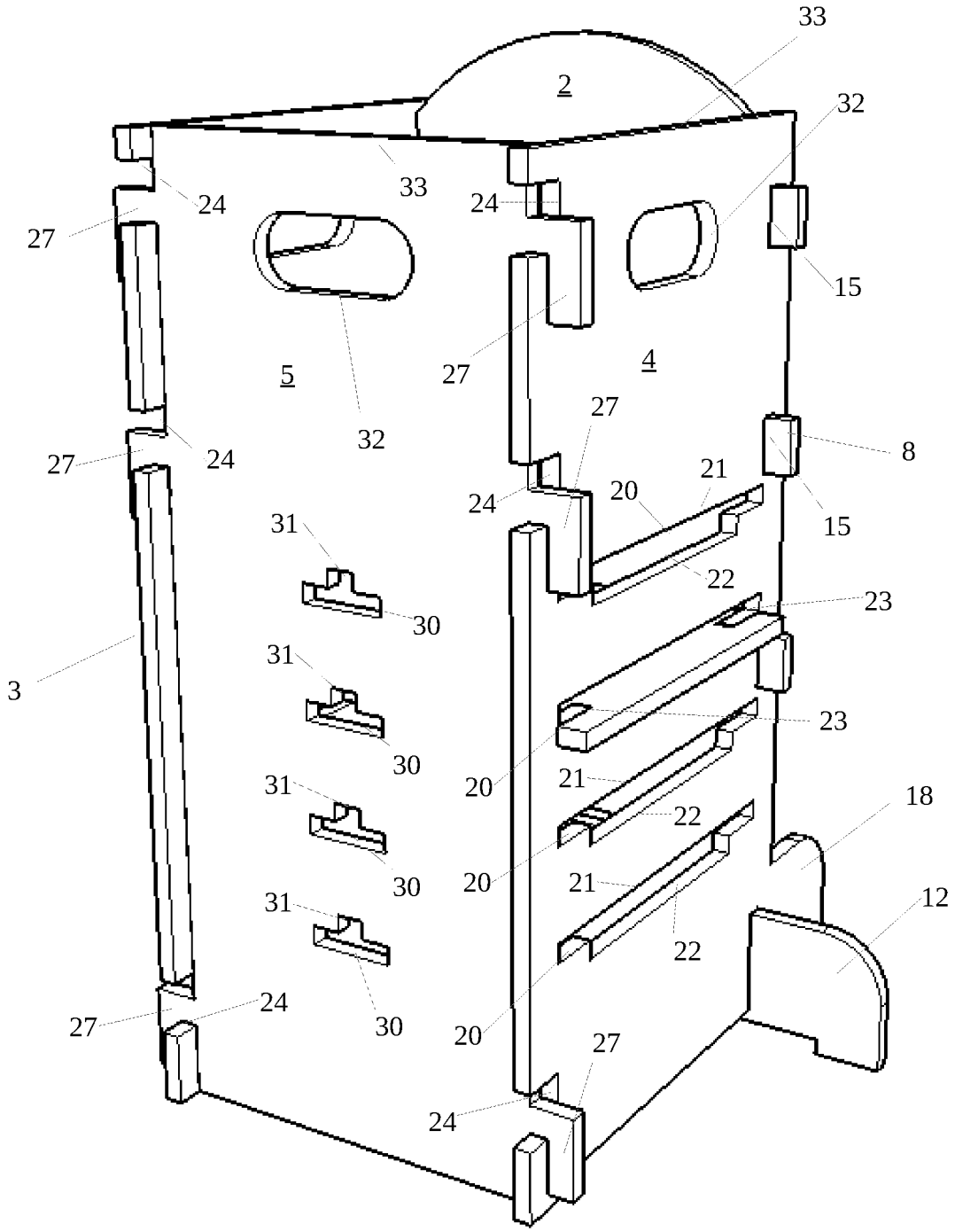
FIG. 6 shows a fifth stage of assembly of a safety stool in accordance with the present invention.

In FIG. 6 a fifth stage of assembly is shown in which the substantially planar second wall 5 has been engaged with second edges 25 of the first and second substantially planar side walls 3, 4 that are distal to the substantially planar first wall 2. Engagement of the substantially planar second wall 5 is performed by lifting and positioning the downward facing hook formations 27 of the substantially planar second wall 5 within the corresponding upward facing hook formations 24 on each of the substantially planar first and second side walls 3, 4. Once positioned the substantially planar second wall 5 is lowered engaging the throats 28 of the downward facing hook formations 27 with the throats 29 of the upward facing hook formations. Removal of the substantially planar second wall 5 is performed by reversing the engagement process. Engagement of the substantially planar second wall 5 acts to further reinforce the structure of the safety stool by providing another level of locking of the substantially planar side walls 3, 4 to the substantially planar first wall 2.

Figure 7A:
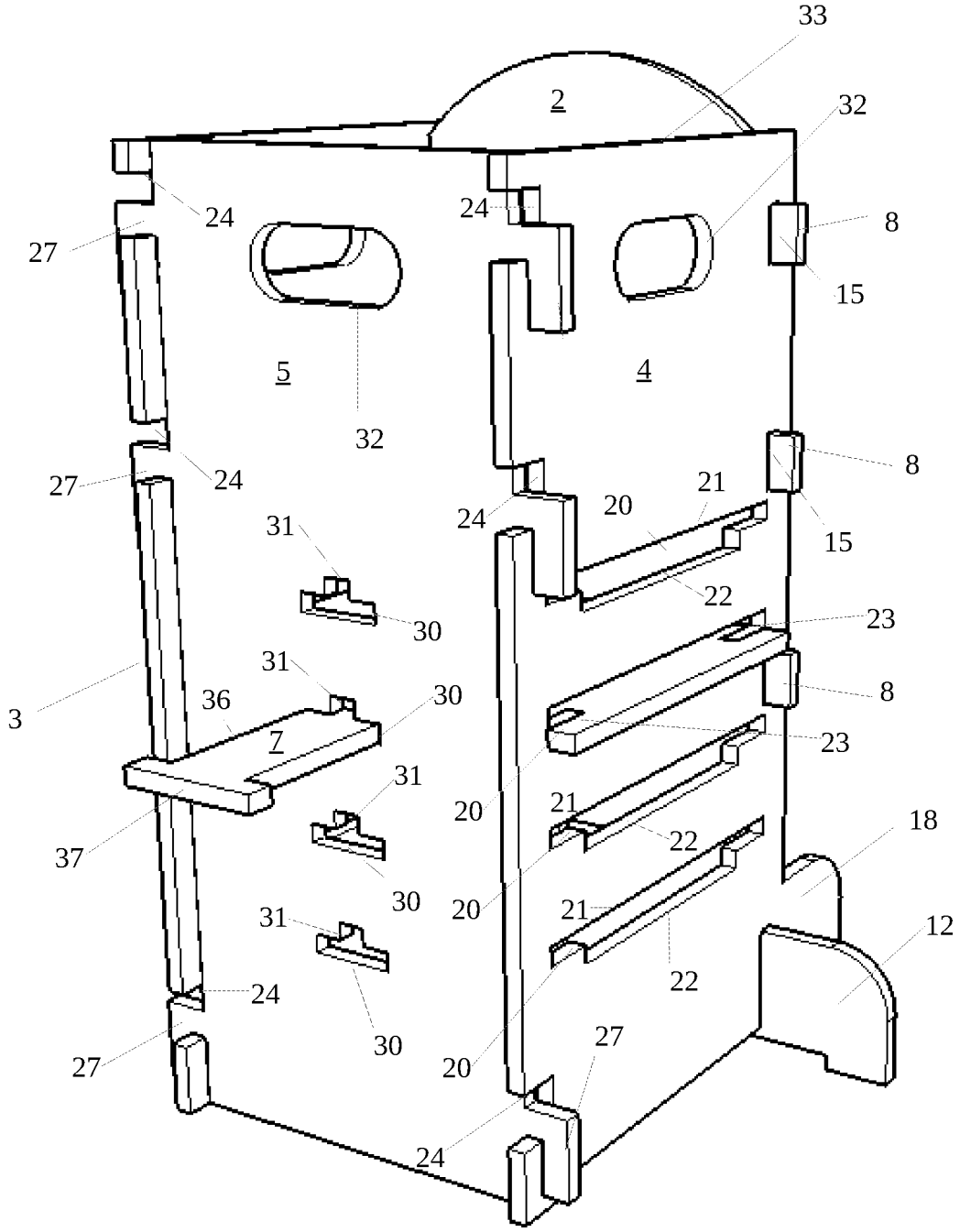
FIG. 7*a* shows a sixth stage of assembly of a safety stool in accordance with the present invention.

In FIG. 7*a* a partially completed sixth stage of assembly is shown, wherein the shaft portion 36 of locking member 7 has been inserted through locking aperture 30 of the substantially planar second wall 5, but does not yet pass through locking aperture 14 of substantially planar first wall 2. Prior to inserting the shaft portion 36 of locking member 7 a user is able to see the presence of the substantially planar platform 6 through additional slot 31 in the locking aperture 30, this allows the locking member 7 to be located immediately below and adjacent the substantially planar platform.

Figure 7B:
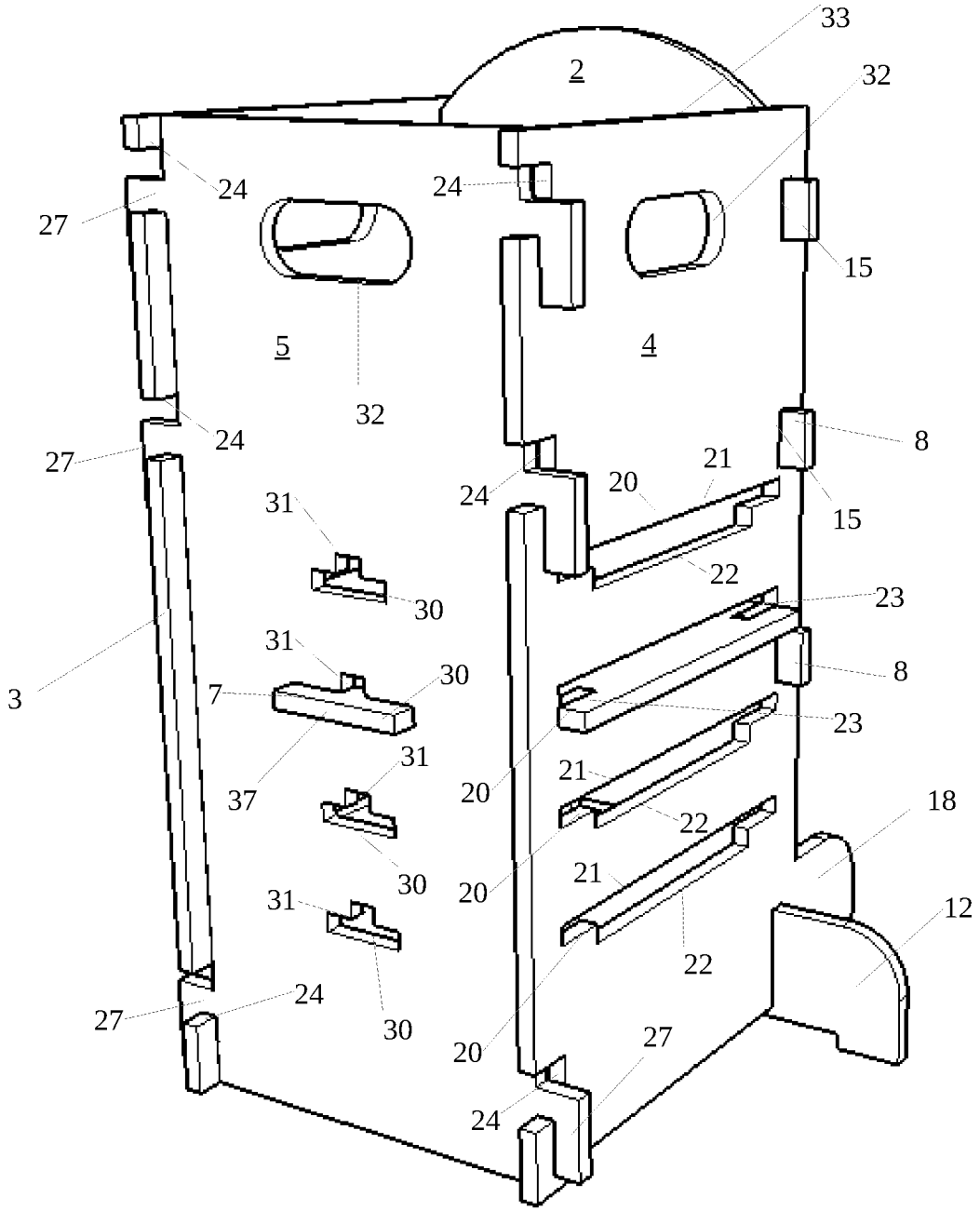
FIG. 7*b* shows a sixth stage of assembly of a safety stool in accordance with the present invention.

FIG. 7*b* shows the safety stool following completion of a sixth stage of assembly. In FIG. 6 the shaft portion 36 of locking member 7 has been inserted through both locking aperture 30 of the substantially planar second wall 5, and through locking aperture 14 of substantially planar first wall 2. The head portion 37 of the locking member 7 abuts against the surface of the substantially planar second wall 5. With the locking member 7 fully inserted the substantially planar second wall 5 is prevented from being lifted and disengaged from the substantially planar side walls 3, 4. This is due to the lifting action of the substantially planar second wall 5 also acting to lift the locking member 7 up against the bottom of the substantially planar platform 6. In use a child cannot free the front wall as they would need to lift their own body weight on the platform as well as the weight of the substantially planar second wall 5.

FIG. 7*b* also illustrates the function of rear support legs 18 and side support legs 11, 12. When assembled the rear support legs 18 on substantially planar side walls 3, 4, of which only one is shown in FIG. 7*b*, extend to a rear of the safety stool, thereby providing stability and preventing the safety stool from toppling in the direction of the substantially planar first wall 2. The side support legs 11, 12 that extend from the substantially planar first wall 2 extend to either side of the safety stool, again only one side support leg 12 is visible in FIG. 7*b*. The side support legs provide stability and prevent the safety stool from toppling in the direction of either of the substantially planar side walls 3, 4. No supports extend substantially beyond the substantially planar second wall 5. In use the substantially planar second wall 5 is typically positioned immediately adjacent a table or bench, the presence of a table or bench prevents toppling of the safety stool in the direction of the substantially planar second wall 5.

In use the safety stool may be assembled to the fourth stage, shown in FIG. 5*b*, after which a child may be lifted, or allowed to step onto the substantially planar platform 6 without the child to be lifted over the full height of the walls. The fifth and sixth stages of assembly are then completed and the safety stool, and contained child, are then moved into position against a bench or table using handle forming apertures 32. Alternatively a table or the like can be positioned in front of the safety stool. In use the substantially planar side walls 3, 4 extend a small distance forward of the substantially planar second wall 5, this provides a small gap between the bench or table and the safety stool, protecting the child from having his or her fingers from being pinched.

It should be noted that various changes and modifications to the embodiments described herein will be apparent to those skilled in the art. Such changes and modifications may be made without departing from the spirit and scope of the invention. It is therefore intended that such changes and modifications be included within scope of the presently described invention.

The invention may also be said broadly to consist in the parts, elements and features referred to or indicated in the specification of the application, individually or collectively, in any or all combinations of two or more of said parts, elements or features.

Where reference in the foregoing description has been made to features or components having known equivalents thereof, those integers are herein incorporated as if individually set forth.

The invention claimed is:

1. A safety stool including:

an adjustable platform;

a first wall unit, and a second wall unit, and a locking member wherein the first wall unit includes a plurality of supports configured to receive and support the adjustable platform, and wherein the second wall unit includes a plurality of locking apertures configured to receive the locking member, and wherein the second wall unit is configured to removably attach to the first wall unit, characterised in that:

a) when the second wall unit is attached to the first wall unit a wall is formed above a top surface of the adjustable platform which substantially surrounds the periphery of the platform and at least one of the plurality of locking apertures is positioned such that when the locking member is located in it, the locking member is held adjacent a bottom surface of the platform, thereby preventing the second wall unit from being able to be detached from the first wall unit;

b) when the second wall unit is not attached to the first wall unit at least a portion of the periphery of the platform is not enclosed by a wall, thereby providing access to the top surface of the platform.

2. The safety stool as claimed in claim 1, wherein the first wall unit includes a first wall, and at least two side walls.

3. The safety stool as claimed in claim 2, wherein the at least two side walls are configured to locate one on each side of the first wall.

4. The safety stool as claimed in any one of claims 2 or 3, wherein the first wall includes a series of locating protrusions that extend outward from opposite sides of the first wall.

5. The safety stool as claimed in claim 4, wherein the side walls include a series of locating apertures which, in use, align with and are configured to be located onto the series of locating protrusions on the first wall.

6. The safety stool as claimed in claim 5, wherein the plurality of locking apertures are positioned so as to have a height that is adjacent to and below a height of a corresponding platform holding aperture.

7. The safety stool as claimed in any one of claims 2 or 3, wherein the at leat two side walls include a plurality of platform holding apertures therethrough, the platform holding apertures configured to, in use, slidingly receive the paltform.

8. The safety stool as claimed in claim 6, wherein each of the platform holding apertures includes a platform sliding portion and a platform engaging portion.

9. The safety stool as claimed in claim 7, wehrein the platform is rectangular in shape and has a firt end and a second end, wherein the first end and the second end each includes a wall engaging portion configured to engage with the platform engaging portion of a platform holding aperture.

10. The safety tool as claimed in claim 8, wherein when the platform wall engaging portion is engaged with the platform engaging portions of the pair of side walls the side walls are prevented from falling away from the first wall.

11. A method of assembling a safety stool, the method of assembly including the steps of:

a) positioning a first wall in a vertical orientation;

b) locating a first wall on a first side of the first wall such that a series of locating protrusions on the first side of the first wall extend through a corresponding series of locating apertures in the first side wall;

c) locating a second side wall on a second side of the first wall such that a series of locating protrusions on the second side of the first wall extend through a corresponding series of locating apertures in the second side wall;

d) sliding a platform horizontally through a first platform holding aperture in the first side wall and through a second platform holding aperture in the second side wall;

e) engaging a platform engaging portion of the first and second platform holding apertures with a first and a second wall engaging portion of the platform;

f) engaging a second wall with sides of the first and second side walls that are distal to the first wall;

g) inserting a locking member through at least one of a plurality of locking apertures formed in the second wall so as to position the locking member adjacent to a bottom surface of the platform.

12. The method of assembling a safety stool as claimed in claim 11, wherein completion of steps a, b and c produces a stable free standing structure in which the first wall is prevented from falling in any direction, and the first and second side walls are prevented from falling inwards towards one another.

13. The method of assembling a safety stool as claimed in claim 12, wherein completion of step e locks the first and second side walls and the first wall together.

14. The method of assembling a safety stool as claimed in any one of claims 11 to 13, wherein completion of the step g prevents the second wall form being disengaged form the first and second side walls.

* * * * *